US006152771A

United States Patent [19]

Juntwait

[11] Patent Number: 6,152,771

[45] Date of Patent: Nov. 28, 2000

[54] IDC CONNECTOR HAVING EMI SHIELD

[75] Inventor: Eric Juntwait, Irvine, Calif.

[73] Assignee: Hon Hai Precision Ind. Co., Ltd., Taipei Hsien, Taiwan

[21] Appl. No.: 09/221,646

[22] Filed: Dec. 28, 1998

[51] Int. Cl.[7] ..... H01R 12/24; H01R 13/648

[52] U.S. Cl. ..... 439/607; 439/497

[58] Field of Search ..... 439/610, 607, 439/101, 608, 609, 497

[56] References Cited

U.S. PATENT DOCUMENTS

| | | | |
|---|---|---|---|
| 4,241,970 | 12/1980 | Rider, Sr. et al. | 439/403 |
| 4,921,441 | 5/1990 | Sauder | 439/460 |
| 5,380,223 | 1/1995 | Marsh et al. | 439/610 |

*Primary Examiner*—Brian Sircus
*Assistant Examiner*—Chandrika Prasad
*Attorney, Agent, or Firm*—Wei Te Chung

[57] ABSTRACT

An IDC connector having EMI shield comprises a dielectric housing defining front and rear faces. An array of passageways is defined between the front and rear faces. Each passageway securely receives a terminal therein. Each terminal forms an insulation displacement section extending beyond the rear face and a pin section extending beyond the front face. A cover is assembled to the rear face for facilitating termination between a flat flexible cable and the insulation displacement sections. An EMI shield is assembled to the housing. The EMI shield includes an upper shell having a shroud surrounding the pin sections. A plurality of flaps extends downward from lower longitudinal sides of the shroud and abuts against outer faces of the housing. A lower shell is engaged with the upper shell for enclosing the cover.

14 Claims, 8 Drawing Sheets

IDC CONNECTOR HAVING EMI SHIELD

FIELD OF THE INVENTION

The present invention relates to an IDC connector, and more particularly to an IDC connector having an EMI shield.

1. Description of Prior Art

As the speed of signal transmission through a cable assembly increases, the need to isolate and protect the signals from electrical noise becomes important. One existing method for achieving this is performed by using a ground plane ribbon cable. The ground plane acts as a barrier to shield the signal lines from noise. However, conductors within an IDC connector are not well shielded by an EMI device whereby the EMI shielding effect is hindered.

2. Summary of the Invention

An objective of this invention is to provide an IDC connector having an EMI shield assembled thereto thereby ensuring reliable signal transmission.

Another objective of this invention is to provide an IDC connector with an EMI shield wherein the shield clamps a portion of a cable thereby ensuring a reliable connection between conductors of the cable and insulation displacement sections of the IDC connector.

In order to achieve the objectives set forth, an IDC connector in accordance with the present invention comprises a dielectric housing defining front and rear faces. An array of passageways is defined between the front and rear faces. Each passageway securely receives a terminal therein. Each terminal forms an insulation displacement section extending beyond the rear face and a pin section extending beyond the front face. A cover is assembled to the rear face for facilitating termination of a flat flexible cable at the insulation displacement sections. An EMI shield is assembled to the housing. The EMI shield includes an upper shell having a shroud surrounding the pin sections. A plurality of flaps extends downward from lower longitudinal sides of the shroud to abut against outer faces of the housing. A lower shell is assembled to the upper shell for enclosing the cover and a portion of the cable.

According to an aspect of the invention, the lower shell includes an outwardly extending platform for supporting the cable. A pressing plate is assembled to the platform of the lower shell for securely positioning the cable against the platform.

BRIEF DESCRIPTION OF THE DRAWINGS

The present invention will be apparent to those skilled in the art by reading the following description of the preferred embodiments thereof, with reference to the accompanying drawings, in which.

DETAILED DESCRIPTION OF THE PREFERRED EMBODIMENTS

Figure 1:
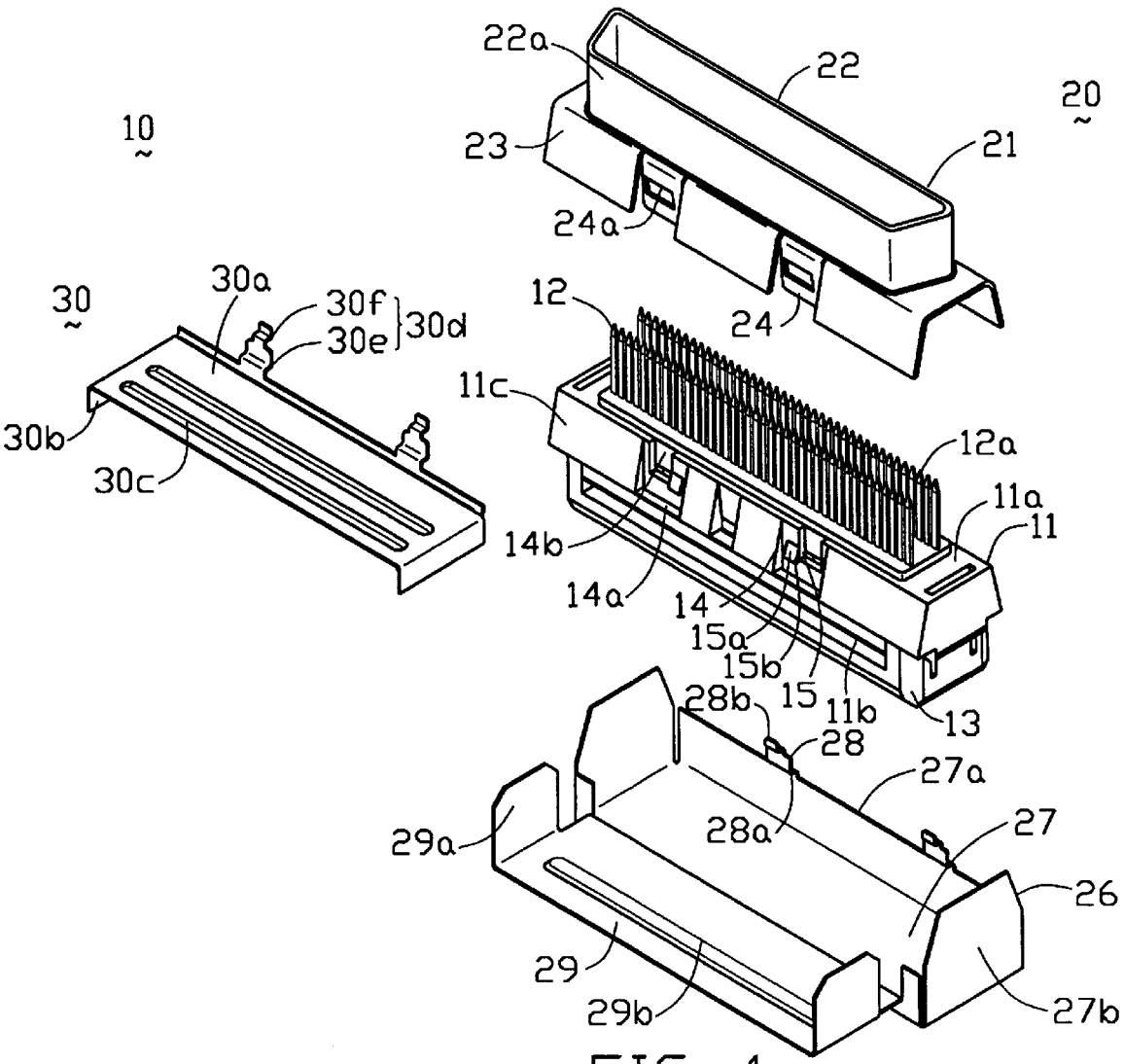
FIG. 1 is an exploded view of an IDC connector in accordance with a first embodiment of the present invention.
Figure 2:
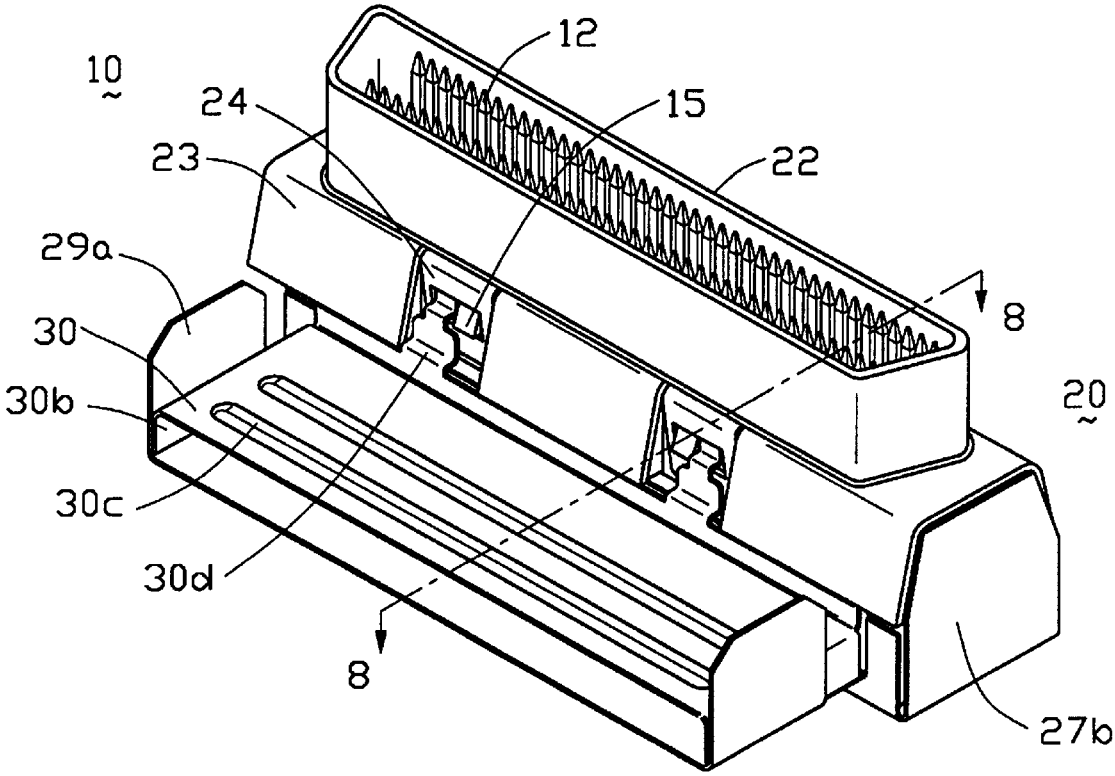
FIG. 2 is an assembled view of FIG. 1.
Figure 3:
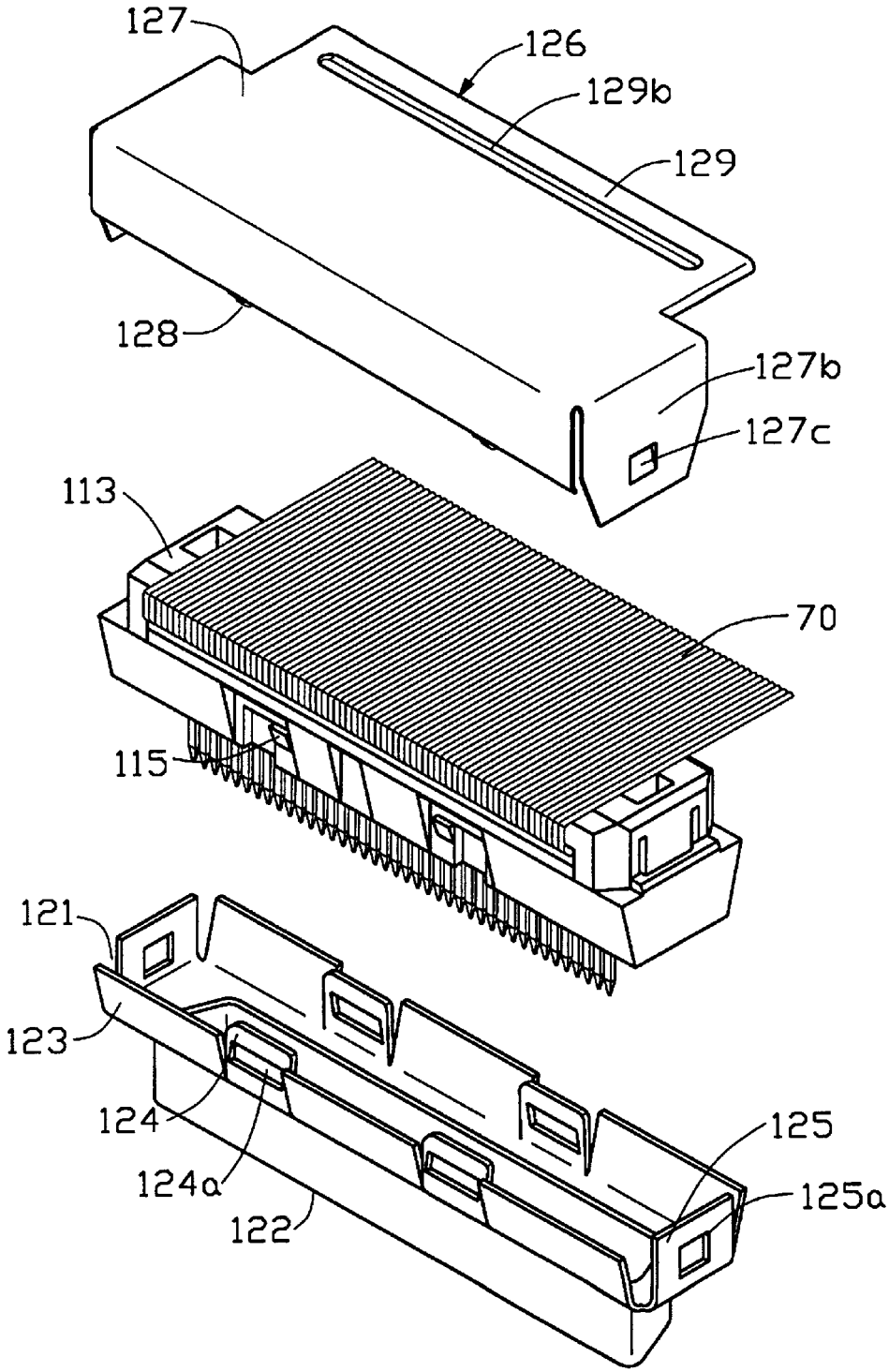
FIG. 3 is an exploded view of an IDC connector in accordance with a second embodiment of the present invention.
Figure 4:
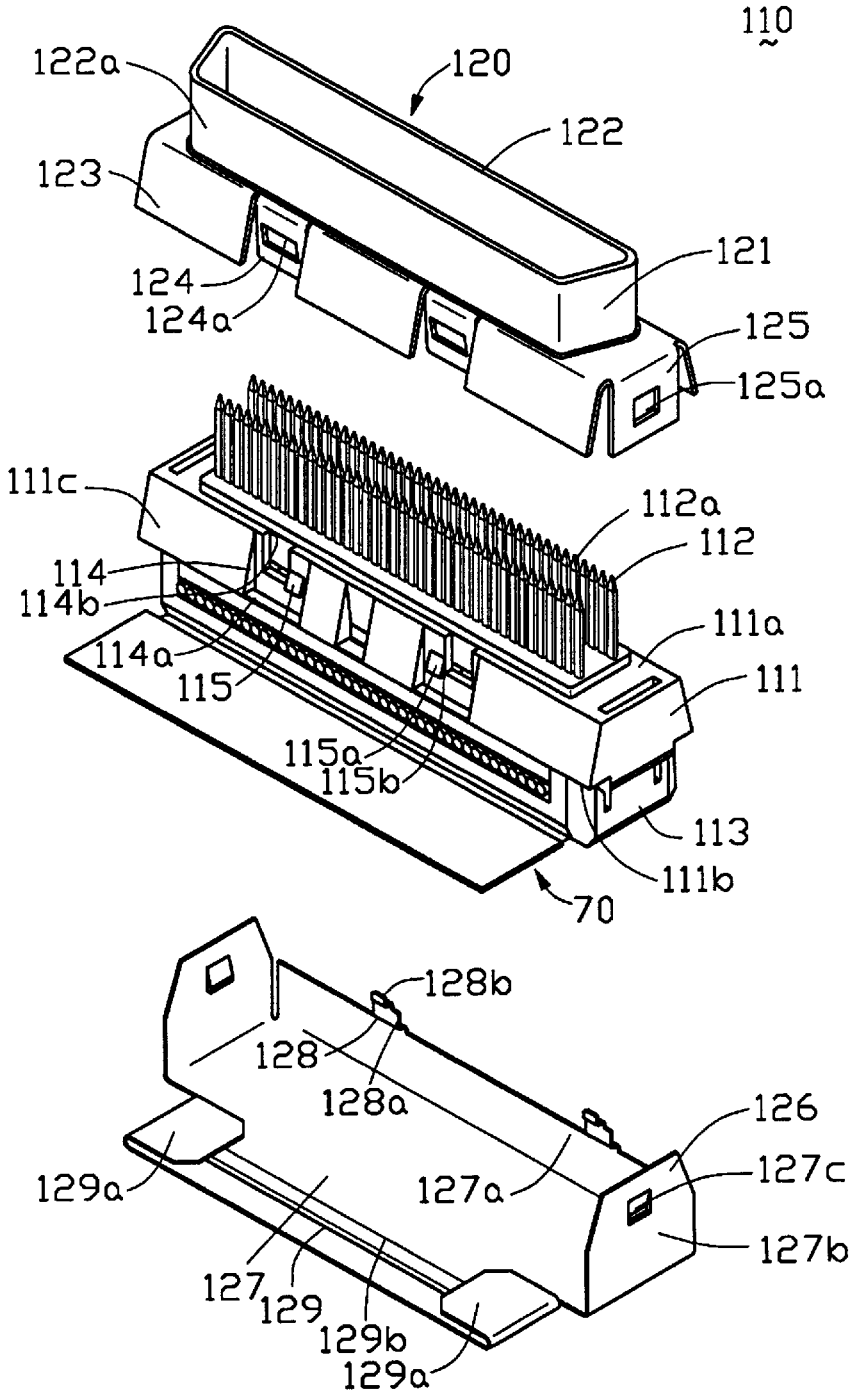
FIG. 4 is similar to FIG. 3 but viewed from a reverse angle.
Figure 5:
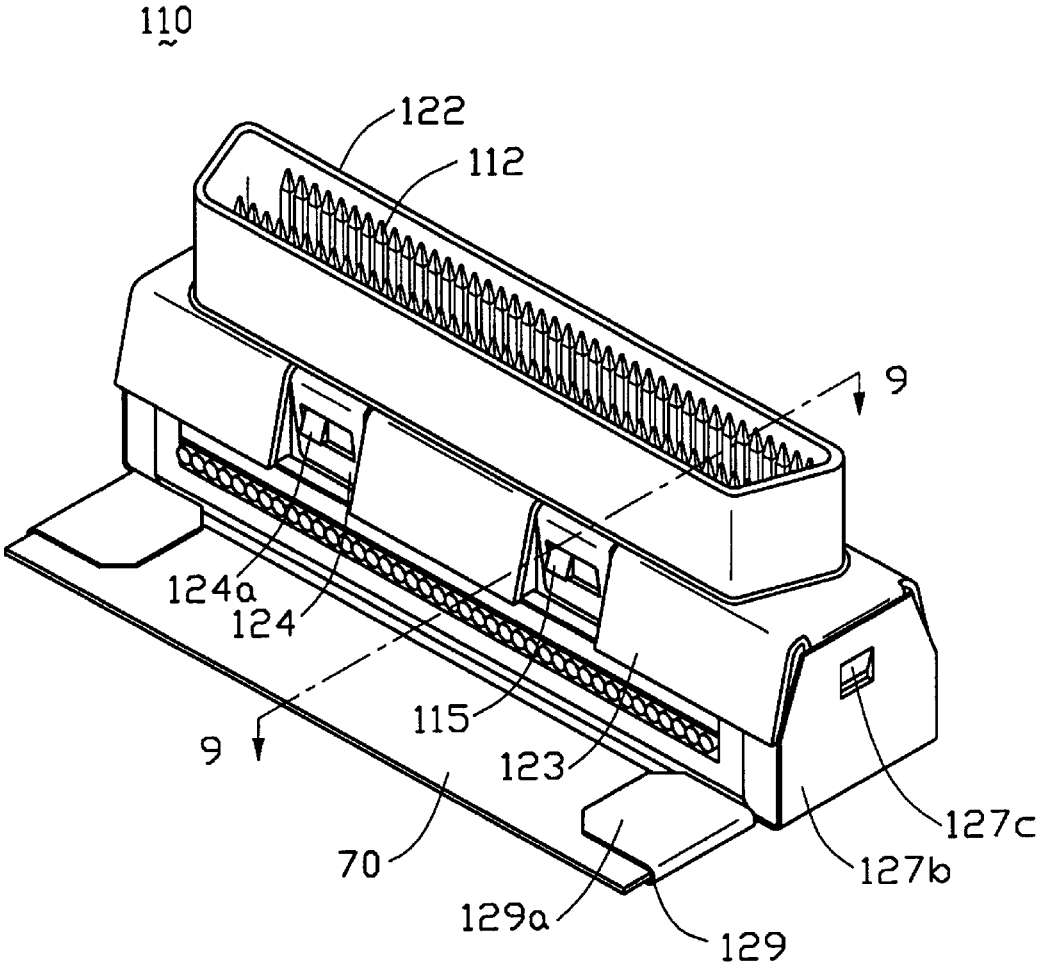
FIG. 5 is an assembled view of FIG. 3.
Figure 8:
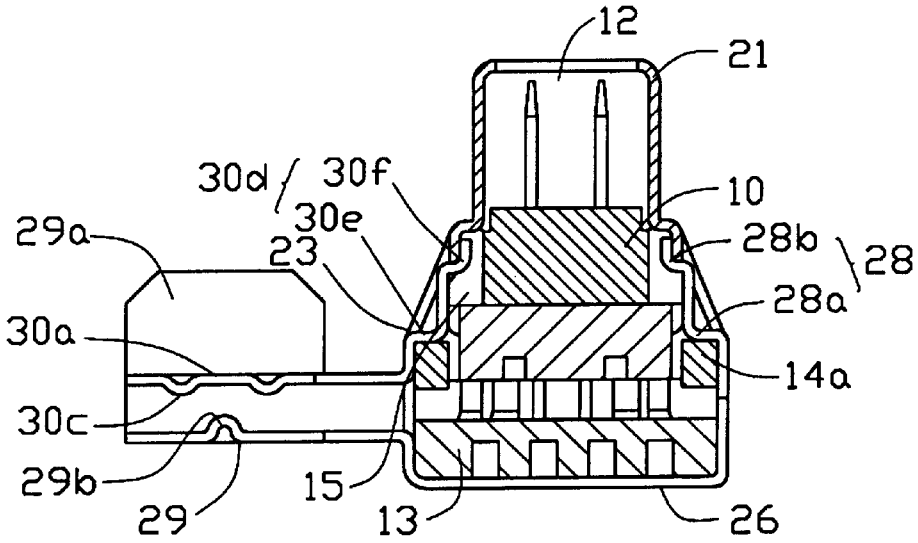
FIG. 8 is a cross sectional view taken along line 8—8 of FIG. 2.
Figure 9:
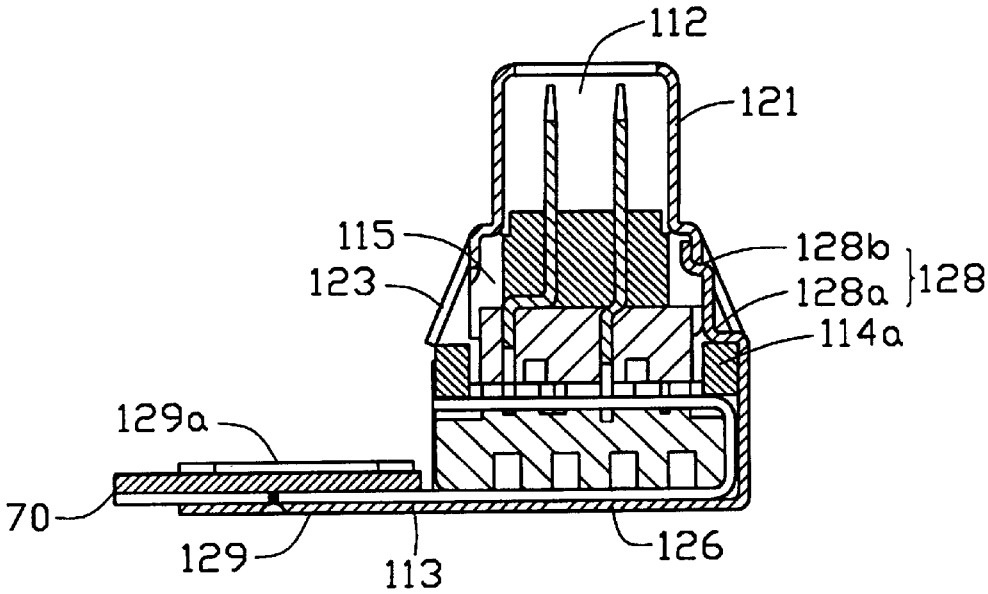
FIG. 9 is a cross sectional view taken along line 9—9 of FIG. 5.

Referring to FIGS. 1, 2, and 8 an IDC connector 10 in accordance with a first embodiment of the present invention includes a trapezoidal dielectric housing 11 having front and rear faces 11*a*, 11*b*. An array of passageways (not labeled) is defined between the front and rear faces 11*a*, 11*b*. Each passageway receives a terminal 12 therein. Each terminal 12 forms an insulation displacement section (not shown) extending beyond the rear face 11*b* and a pin section 12*a* extending beyond the front face 11*a*. A cover 13 is assembled to the rear face 11*b* for facilitating termination of a flat flexible cable 70 (FIG. 3) at the insulation displacement sections. The housing 11 defines two pairs of recesses 14 in opposite walls 11*c* thereof. Each recess 14 is formed with a shoulder 14*a* at a bottom periphery thereof and a wedge 15 having an inclined leading face 15*a* and a stopping face 15*b*. Each recess 14 is further defined with an indent 14*b* adjacent to the wedge 15.

An EMI shield 20 assembled to the housing 11 includes an upper shell 21 and a lower shell 26. The upper shell 21 forms a shroud 22 for surrounding the pin sections 12*a* of the terminals 12. Three spaced flaps 23 extend downward from lower longitudinal sides 22*a* of the shroud 22 for abutting against the walls 11*c* of the housing 11 when the upper shell 21 is assembled thereto. Buckles 24 extend downward from the lower longitudinal sides 22*a* between adjacent flaps 23. Each buckle 24 defines an elongate slot 24*a* for engaging with the wedge 15 of the housing 11.

The lower shell 26 is assembled to the upper shell 21 thereby enclosing the housing 11. The lower shell 26 includes a base 27 having a longitudinal wall 27*a* and two end walls 27*b* extending from a periphery thereof. A pair of clips 28 extends from the longitudinal wall 27*a* for engaging with the buckles 24 of the upper shell 21. The clip 28 includes a corner 28*a* for being supported on the shoulder 14*a* of the recess 14 and a tip 28*b* extending into the elongate slot 24*a* when the lower shell 26 is assembled to the upper shell 21.

The lower shell 26 further includes a platform 29 extending outwardly therefrom for supporting the cable 70. The platform 29 forms a pair of side wings 29*a* at opposite ends thereof. A rib 29*b* is longitudinally formed on the platform 29.

A pressing plate 30 is assembled to the platform 29 of the lower shell 26 thereby pressing the cable 70 to the platform 29. The pressing plate 30 includes a base 30*a* corresponding to the platform 29 and a pair of short wings 30*b* extending downward from opposite ends thereof. The height of each short wing 30*b* is designed to be equal to or less than the thickness of the cable 70 whereby the cable 70 is securely clamped therebetween. The base 30*a* further forms a pair of ribs 30*c* having a staggered relationship with the rib 29*b* of the platform 29. By this arrangement, the cable 70 is further clamped therebetween.

A pair of clips 30*d* extends from a longitudinal side of the pressing plate 30 for engaging with the buckles 24 of the upper shell 21. Each clip 30*d* includes a corner 30*e* for being supported on the shoulder 14*a* of the recess 14 and a tip 30*f* which extends into the slot 24*a* of the buckle 24 when the pressing plate 30 is assembled to the upper shell 21.

Referring to FIGS. 3, 4, 5 and 9, an IDC connector 110 in accordance with a second embodiment of the present invention has the same configuration as the IDC connector 10 of the first embodiment except that the pressing plate 30 is omitted. The IDC connector 110 includes a trapezoidal dielectric housing 111 having front and rear faces 111*a*, 111*b*. An array of passageways (not labeled) is defined between the front and rear faces 111*a*, 111*b*. Each passageway receives a terminal 112 therein. Each terminal 112 forms an insulation displacement section (not shown) extending beyond the rear face 111*b* and a pin section 112*a* extending beyond the front face 111*a*. A cover 113 is assembled to the rear face 111*b* for facilitating termination of the flat flexible cable 70 at the insulation displacement sections. The dielectric housing 111 defines two recesses 114 on opposite walls 111*c* thereof. Each recess 114 is formed with a shoulder 114*a* on a bottom periphery thereof and a wedge 115 having an inclined leading face 115*a* and a stopping face 115*b*. The recess 114 is further defined with an indent 114*b* adjacent to the wedge 115.

An EMI shield 120 assembled to the housing 111 includes an upper shell 121 and a lower shell 126. The upper shell 121 forms a shroud 122 for surrounding the pin sections 112*a* of the terminals 112. Three spaced flaps 123 extending downward from each of lower longitudinal sides 122*a* of the shroud 122 abut against the walls 111*c* of the housing 111 when the upper shell 121 is assembled thereto. Buckles 124 extend downward from the lower longitudinal sides 122*a* between adjacent flaps 123. Each buckle 124 defines an elongate slot 124*a* for engaging with the wedge 115 of the housing 111.

The lower shell 126 is assembled to the upper shell 121 thereby enclosing the housing 111. The lower shell 126 includes a base 127 having a longitudinal wall 127*a* and end walls 127*b* extending from a periphery thereof. A pair of clips 128 extends from the longitudinal wall 127*a* for engaging with the buckles 124 of the upper shell 121. The clip 128 includes a corner 128*a* for being supported on the shoulder 114*a* of the recess 114 and a tip 128*b* extending into the elongate slot 124*a* when the lower shell 126 is assembled to the upper shell 121.

The lower shell 126 further includes a platform 129 extending horizontally therefrom for supporting a portion of the cable 70. The platform 129 forms a pair of side wings 129*a* at opposite ends thereof. A rib 129*b* is longitudinally formed on the platform 129.

The upper shell 121 includes a pair of end flaps 125 defining an opening 125*a* therein. The end wall 127*b* of the lower shell 126 is formed with a clip 127*c* corresponding to the opening 125*a*. When the lower shell 126 is assembled to the upper shell 121, enhanced engagement therebetween is achieved by the engagement between the opening 125*a* and the clip 127*c*. In addition, the side wings 129*a* are directly deformed to clamp the cable 70 whereby the provision of the pressing plate 30 of the first embodiment is unnecessary.

Figure 6:
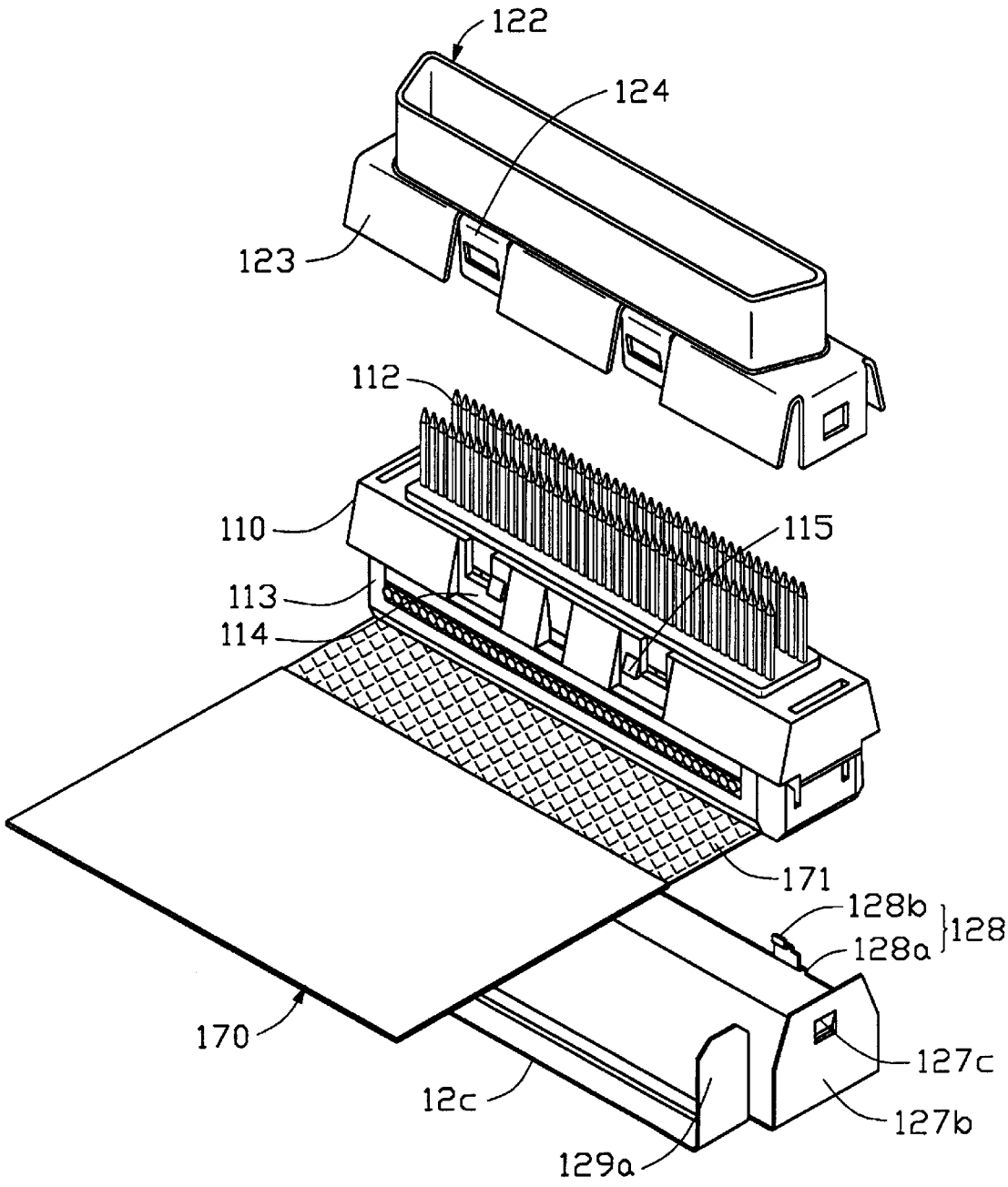
FIG. 6 is an exploded view of an IDC connector in accordance with a third embodiment of the present invention.
Figure 7:
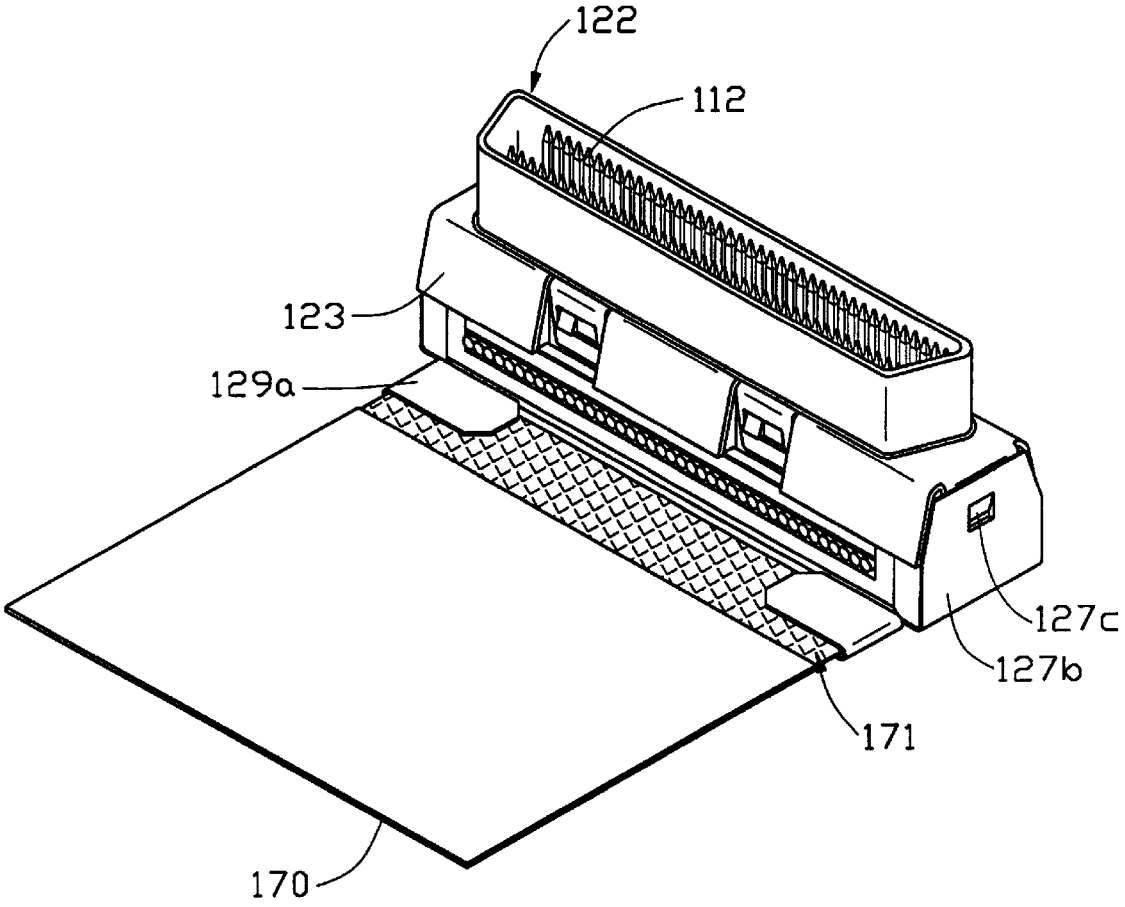
FIG. 7 is an assembled view of FIG. 6.

FIGS. 6 and 7 disclose a variation of a cable 170. The cable 170 includes a ground plane 171 directly connected to the side wings 129*a* thereby establishing a grounding path therebetween.

It can be noted that in the first embodiment the rib 29*b* and the ribs 30*c* can clamp the cable therebetween, so the shield 20 cooperating with the pressing plate 30, may function as a strain relief. Similarly, in the second embodiment the rib 129*b* and the wings 129*a* can clamp the cable therebetween and also function as a strain relief. In other words, the invention provides both EMI shielding and strain relief functions, whereas the traditional IDC connector provides only strain relief and no shielding function.

It is also seen that in the second embodiment (FIG. 9), the cable extends along an inside of one side and the bottom of the lower shell 126 between the lower shell 126 and the housing 111 and is exposed to an exterior on the other side of the housing 111, thus enhancing the engagement between the cable and the housing.

Although the present invention has been described with reference to preferred embodiments thereof, it is apparent to those skilled in the art that a variety of modifications and changes may be made without departing from the scope of the present invention which is intended to be defined by the appended claims.

I claim:

1. An IDC connector, comprising:

a dielectric housing defining front and rear faces, an array of passageways defined between said front and rear faces, each passageway securely receiving a terminal therein, each said terminal forming an insulation displacement section extending beyond said rear face and a pin section extending beyond said front face, a cover assembled to said rear face for facilitating termination of a flat flexible cable at said insulation displacement sections, at least a wedge formed on an outer wall of said housing; and an EMI shield assembled to said housing and including an upper shell having a shroud surrounding said pin sections and a lower shell for enclosing said cover, at least a buckle extending downward from said shroud and defining a slot engaging with the wedge of the housing, the lower shell including at least a clip engaging with said buckle of the upper shell.

2. The IDC connector as recited in claim 1, wherein said lower shell includes a platform for supporting said cable.

3. The IDC connector as recited in claim 2, wherein a pressing plate is assembled to said platform of said lower shell for securely positioning said cable in said platform.

4. The IDC connector as recited in claim 2, wherein said platform includes a pair of side wings extending from transverse sides thereof.

5. The IDC connector as recited in claim 1, wherein said upper shell includes a pair of end flaps extending from opposite ends thereof for engaging with end walls extending upwardly from opposite ends of said lower shell.

6. The IDC connector as recited in claim 5, wherein one of said end flaps and said end walls defines an opening for interlocking with a clip integrally formed on the other of said end flaps and said end walls.

7. The IDC connector as recited in claim 2, wherein said platform includes a pair of side wings on opposite ends thereof, each side wing can be deformed to clamp a ground plane of said cable.

8. A cable connector, comprising:

a dielectric housing defining front and rear faces;

a plurality of terminals positioned between said front and rear faces, each of said terminals including a rear section connecting to a cable around the rear face; and an EMI shield assembly enclosing said connector and clamping the cable so as to function as both shielding and strain relief;

said shield assembly including an upper shell and a lower shell secured to the housing, said lower shell and said upper shell being asymmetric to the housing with said lower shell being significantly different from and much larger than said upper shell; wherein said upper shell essentially extends horizontally from one side of and perpendicularly to the housing where the cable extends out of the connector, while the lower shell essentially extends from the other side of the housing to said side with several bends formed thereon to shield said other side and said rear face of the housing.

9. The cable connector as recited in claim 8, wherein said EMI shield assembly further includes a pressing plate cooperating with the lower shell to sandwich the cable therebetween.

10. The cable connector as recited in claim 8, wherein said upper shell and said lower shell have means for securing to each other.

11. The cable connector as recited in claim 8, wherein the shield assembly includes a platform extending around the rear face of the housing and perpendicular to the terminals whereby clamping function of the cable occurs thereabouts.

12. A cable connector comprising:

a dielectric housing defining front and rear faces;

a plurality of terminals positioned between said front and rear faces, each of said terminals including a rear section connecting to a cable around the rear face; and an EMI shield assembly enclosing said connector, said EMI shield assembly including an upper shell and a lower shell so that said cable extends outward between said upper shell and said lower shell;

said lower shell and said upper shell being asymmetric to the housing in both dimension and shape; wherein said upper shell essentially extends horizontally from one side of and perpendicularly to the housing where the cable extends, while the lower shell essentially extends from the other side of the housing to said side with several bends formed thereon to shield said other side and said rear face of the housing and the associated cable thereabouts.

13. The IDC connector as recited in claim 1, wherein said housing defines at least a recess in the wall thereof, said buckle extends into the recess and the wedge of the housing is formed in the recess.

14. The IDC connector as recited in claim 13, wherein said recess is defined with an indent adjacent to the wedge, said clip of the lower shell extends through the slot of the buckle into the indent.

* * * * *